US005632637A

United States Patent [19]

Diener

[11] Patent Number: 5,632,637

[45] Date of Patent: May 27, 1997

[54] CABLE CONNECTOR

[75] Inventor: John R. Diener, Wendell, N.C.

[73] Assignee: Phoenix Network Research, Inc., Wendell, N.C.

[21] Appl. No.: 304,665

[22] Filed: Sep. 9, 1994

[51] Int. Cl.[6] ..... H01R 29/00

[52] U.S. Cl. ..... 439/188; 439/620

[58] Field of Search ..... 439/188, 395, 439/578, 638, 654, 391, 344

[56] References Cited

U.S. PATENT DOCUMENTS

| | | | |
|---|---|---|---|
| 3,784,950 | 1/1974 | Coffman | 439/188 |
| 4,648,682 | 3/1987 | Tubbs | 439/391 |
| 4,660,921 | 4/1987 | Hauver | 439/578 |
| 4,681,390 | 7/1987 | Hayward | 439/578 |
| 4,740,172 | 4/1988 | Tubbs | 439/344 |
| 5,073,123 | 12/1991 | Birch et al. | 439/188 |
| 5,076,797 | 12/1991 | Moulton | 439/188 |
| 5,219,299 | 6/1993 | Wang | 439/188 |
| 5,237,293 | 8/1993 | Kan et al. | 439/578 |
| 5,238,422 | 8/1993 | Scherer | 439/188 |
| 5,246,378 | 9/1993 | Seiceanu | 439/188 |
| 5,321,218 | 6/1994 | Vause | 439/188 |
| 5,338,215 | 8/1994 | Lee et al. | 439/188 |
| 5,352,127 | 10/1994 | Muller et al. | 439/188 |
| 5,374,199 | 12/1994 | Chung | 439/188 |

*Primary Examiner*—David L. Pirlot
*Assistant Examiner*—Jill Demello
*Attorney, Agent, or Firm*—Hale and Dorr

[57] ABSTRACT

A self-terminating connector has a movable conductor for automatically terminating a connector that carries an RF signal when the connector is disconnected from a corresponding connector. The connector terminates through a 75 ohm resistance that is mounted in the housing.

15 Claims, 3 Drawing Sheets

CABLE CONNECTOR

FIELD OF THE INVENTION

This invention relates to a connector for a cable, and in particular for a cable which carries an RF signal.

BACKGROUND OF THE INVENTION

When a cable carrying an RF signal, such as a cable television signal, is disconnected from a television set or a cable box, the RF signal is emitted into the environment unless the connector is properly terminated. If a cable provider is aware of a non-terminated connector, its personnel can attach a terminator to the connector. In the case of a coaxial cable connector, the terminator is attached to the end of the connector to short the center conductor to an outer circumferential conductor with a 75 ohm resistance.

As the number of non-terminated emitting connectors increases, the power output from the cable plant must be increased to compensate for the lost power from non-terminated connectors. The signals emitted in the atmosphere can also cause interference with other vital communications sources, such as airport traffic control. If the problem becomes particularly severe, a cable provider must send out a "sniffer truck" to detect RF signals in the environment and order to locate the source of leakage.

At a household, such leakage can be caused in a number of different ways. For example, a consumer who is receiving a cable television signal might disconnect the cable from the cable box to the television temporarily if the television is being repaired. Another possibility is that the customer might attach a splitter to the cable box to run a separate cable to a video cassette recorder. Later, the consumer may stop using the recorder, but not remove the splitter. Some people, when they move have been known to is remove the cable all the way to a ground fixture outside the house, thus leaving open the possibility that the signal could be emitted from the ground fixture. It is also increasingly common for cable fixtures to be built into new homes or in remodeled rooms. Fixtures are positioned in the wall similar to telephone fixtures for convenient attachment. If the signal is not properly terminated at each fixture, a signal can be emitted out of any non-terminating fixture.

SUMMARY OF THE INVENTION

Because of the harmful effects of non-terminated connections to cable operators and to other forms of communication, and because cable operators are not able to conveniently terminate each connector individually, I have developed a connector in which a termination is automatically made when a connector is disconnected from a mating connector. The connector has a switching mechanism for selectively coupling conductors in the connector in response to connecting or disconnecting the connector from a corresponding mating connector. My self-terminating connector is particularly useful in connection with cable systems, but it can also be used in any application, in which a signal is emitted if not terminated. The connector according to the present invention can be manufactured into other products such as cables, splitters, modulators, or wall fixtures; or the self-terminating aspect can be incorporated into an adapter to retrofit an existing connector.

A self-terminating connector can be incorporated into either a male or a female connector, such as a common f connector used for cable television. A female f connector has a first conductor including a conductive receptacle for receiving conductor a prong of a male f conductor, and a grounded second conductor. In one embodiment, the first conductor includes a conductor that is movable from a first position, in which the movable conductor couples the first conductor and the second conductor to form an electrical path, to a second position in which the movable conductor does not connect these conductors. The movable conductor may include a spring-biased conducting body. When the female connector is not connected to a male connector, the body is biased to contact a stationary conducting washer which is coupled to the grounded conductor through a 75 ohm resistance. When the male connector is inserted in the female connector, the male prong pushes the spring to move the body out of contact with the washer. As used here, conductor is not limited to any specific range of conductivity, but refers to a member that carries an electrical signal.

The self-terminating feature can be used in a male connector. The connector preferably has a mechanical switching mechanism in which the conducting prong is spring biased and has an increased diameter portion which abuts a conducting member to terminate when the male connector is not connected to a female connector. When it is connected, the prong is moved so that the increased diameter portion is separated from the conducting member.

A connector according to the present invention may be built into a device, such as cable box, and may be provided in an adapter for connection to a female or a male connector, or at the end of a cable.

According to the present invention, a simple and reliable self-terminating connector prevents the harmful problems caused by live, non-terminated connectors, such as interference with other communications systems. The connection terminates automatically when disconnected, meaning that there is no need for additional user/customer action. According to a preferred embodiment, only one of a male and female connection need be modified, while the other may be the same as a prior art connector.

BRIEF DESCRIPTION OF THE DRAWINGS

Other features and advantages will become apparent from the following detailed description and from the drawings in which.

DETAILED DESCRIPTION

Figure 1:
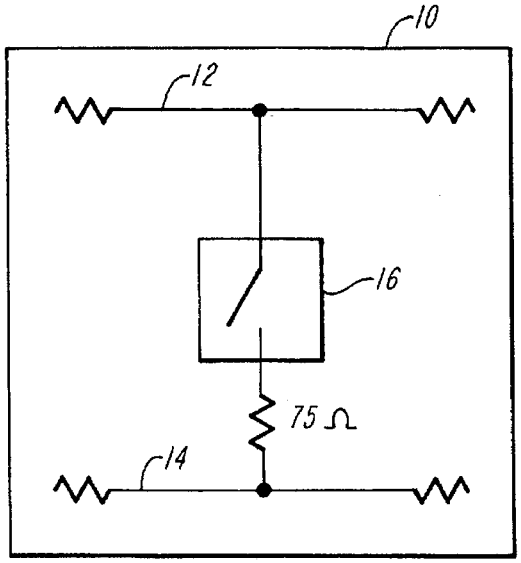
FIG. 1 is a partial schematic representation of an embodiment of the invention.

Referring to FIG. 1, in an embodiment of the present invention shown in general schematic form, a connector 10 has a first conductor 12 and a second conductor 14 for mating with a corresponding connector. These conductors, which may be coupled to a coaxial cable or a cable box for carrying a cable television signal, are selectively coupled to each other through a 75 ohm resistor with a mechanically actuated switch 16. Switch 16 is preferably actuable automatically in response to the mating action of a connector with a corresponding connector (not shown), and thus the connector can automatically self-terminate.

Figure 2:
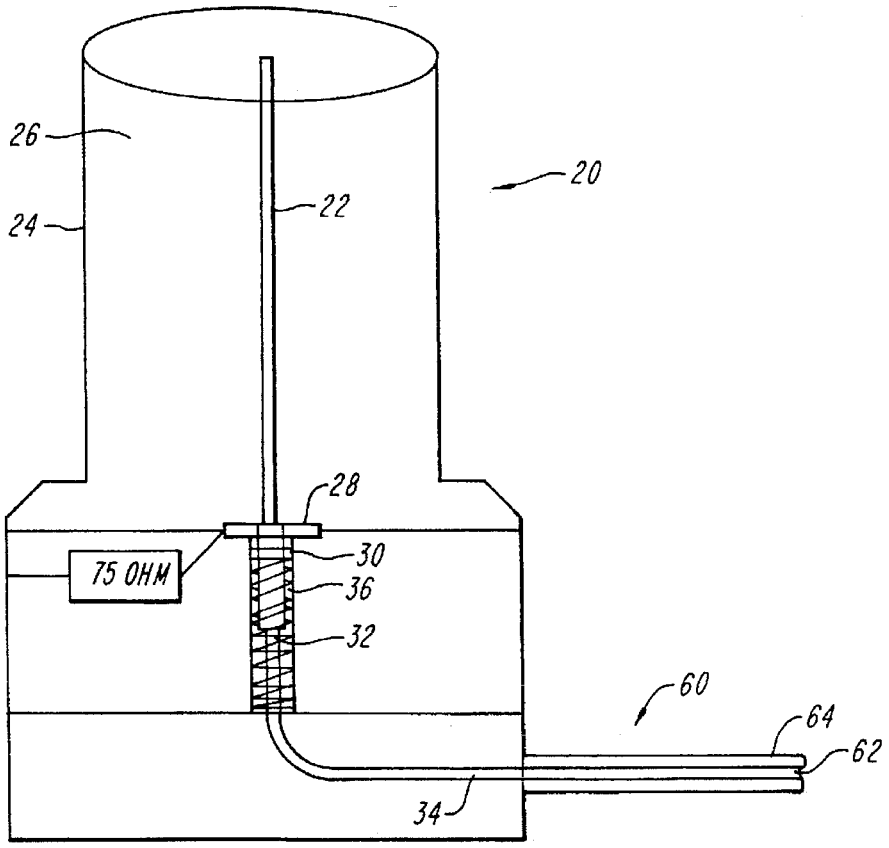
FIGS. 2 and 3 are partial cross-sectional views of an embodiment of the present invention.
Figure 3:
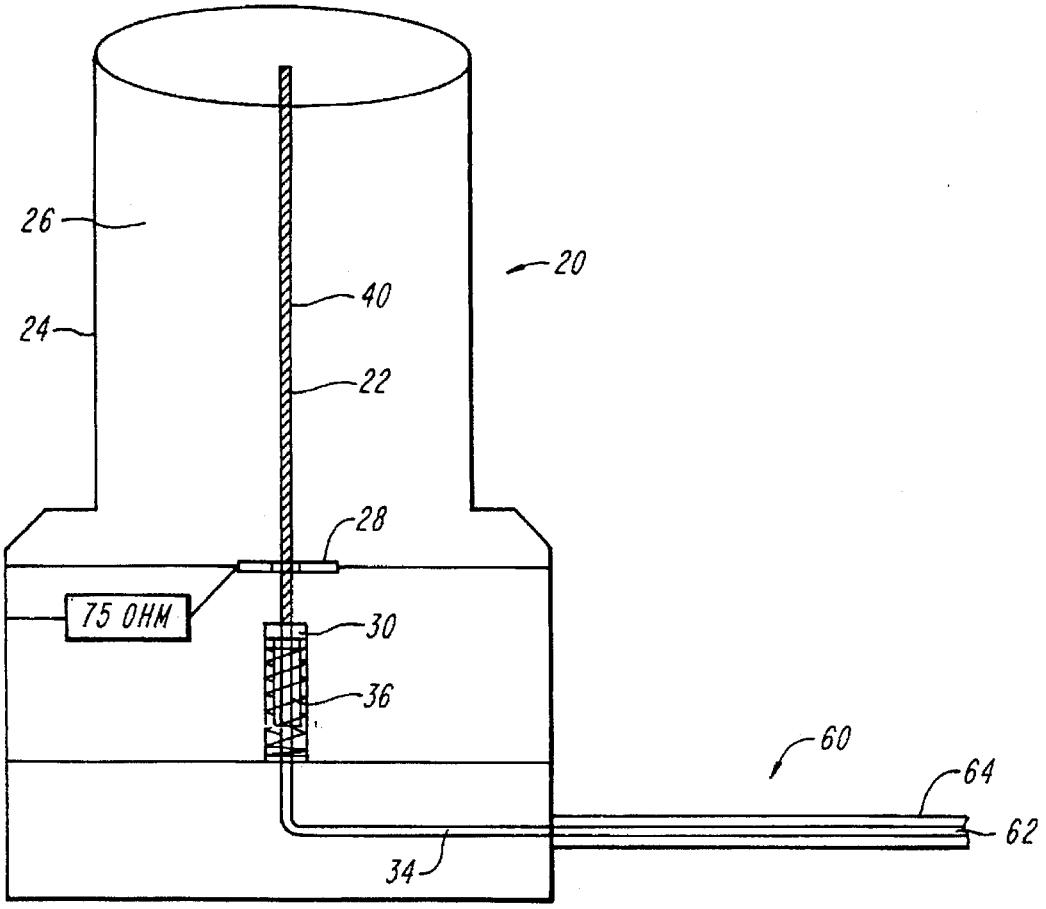

Referring to FIGS. 2 and 3, a female f connector 20 is shown respectively disconnected and connected to a male f connector. Connector 20 has a first conductor including a tubular, axial, conductive receptacle 22, and a second conductor including a conductor 24 arranged coaxially and circumferentially around connector 20. Conductor 24 may be threaded and can be used in connection with a known male f connector that has a typical threaded locking nut or a quick-connect arrangement. Conductors 22 and 24 are separated by an electrically insulating material 26. The connector may be electrically coupled to a coaxial cable 60 having conductors 62, 64.

Second conductor 24 includes an annular washer 28 that is stationarily mounted in connector 20 so that it surrounds receptacle 22. Washer 28 is coupled to conductor 24 through a 75 ohm resistance. A movable conducting cup 36 is biased against washer 28 with a spring 32 so that a portion of the cup (such as flange 30 which is shown more clearly in FIG. 4) contacts the washer. The cup is electrically coupled to a conductor 34, which in turn is coupled to coaxial cable 60 for carrying a live signal.

When connector 20 is not coupled to a male connector, a signal on conductor 34 is electrically conducted through cup 36, washer 28, the 75 ohm resistance, and conductor 24. Thus, the signal is dissipated by the resistance and is not emitted into the environment.

Figure 5:
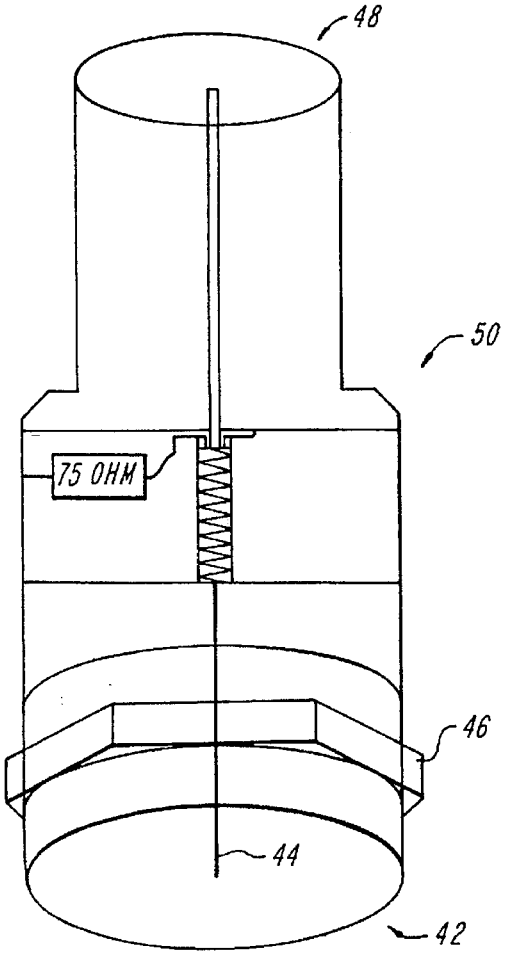
FIG. 5 is a partial cross-sectional view of an adapter according to the present invention.

Referring to FIG. 3, when a male connector is inserted in female connector 20, a cylindrical male prong 40 is inserted into the tubular conductor 22 (the rest of the male conductor is not shown for clarity, but it would typically have a cylindrical conductor which would fit over the outside of conductor 24, as shown at male end 42 in FIG. 5). When prong 40 is inserted into connector 20, it pushes cup 36, thus compressing spring 32 and breaking the physical and electrical connection between flange 30 and washer 28 that previously coupled the first and second conductors. As a result, an electrical signal can be electrically coupled from conductor 34 through prong 40 without interference from the 75 ohm resistance.

Figure 4:
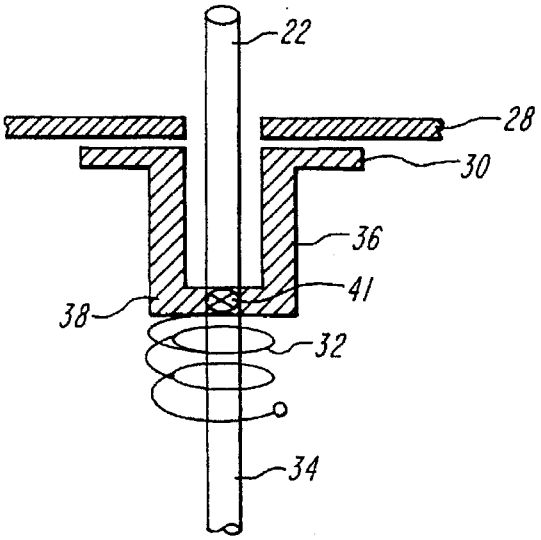
FIG. 4 is a close-up view of a receiving cup.

Referring to FIG. 4, the connection is shown in more detail and flange 30 is shown more explicitly. Cup 36 has a split spring assembly 41 located centrally in a bottom portion 38. Spring assembly 41, which generally resembles a split opening found in a plastic soft-drink lid, is made sufficiently tight so that it forms a good electrical connection when a male prong is inserted, and so that the spring is compressed when the male prong is inserted. Alternative forms of connection, such as a standard Y-shaped conductive receiver, could also be used at the bottom portion of cup 36. Flange 30 may be omitted so that the cup is cylindrical without a flange.

The connector may be used in a number of different ways, including at the end of a cable, on the housing of a cable television box, or in a wall-mounted jack. The self-terminating concept can also be employed in an adapter to retrofit an existing connector. Referring to FIG. 5, a female-to-female adapter has a male end 42 with a center conducting prong 44 and a locking nut 46. The female end 48 is similar to that shown in FIG. 2 and is electrically coupled to the male end. These adaptors can be used to retrofit an existing female connector to form a new self-terminating female connector. For example, one could connect an adapter to each female connector on a splitter so that if one of the multiple output connectors on the splitter is disconnected, the signal would be terminated. The adapter could also convert male to female by having two female ends.

Figure 6:
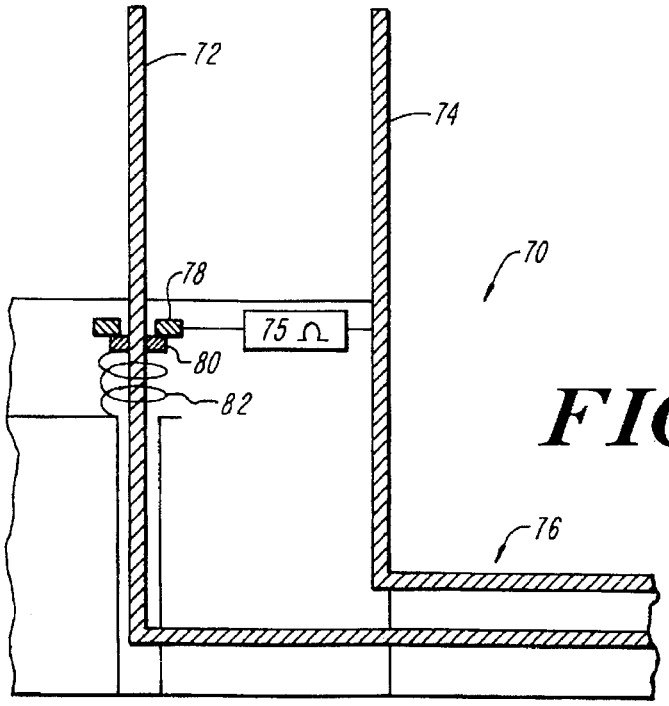
FIG. 6 is a partial cross-sectional view of another embodiment of the present invention.

A movable conductor could be employed in a self-terminating male connector to terminate at the male end when it is inserted into a typical female f connector. Referring to FIG. 6, male connector 70 has an axial prong 72 and a cylindrical conductor 74 circumferentially mounted relative to the prong for coupling to a coaxial cable 76. Conductor 74 is coupled through a 75 ohm resistance to a stationary member, such as a washer 78. The prong has an increased diameter portion 80 that is spring-biased against washer 78 with coil spring 82 to couple prong 72 and conductor 74. The prong is sized so that when it is inserted into a female receptacle, the increased diameter portion is pushed away from the washer and the electrical connection between prong 72 and conductor 74 is broken. As with the self-terminating female f connector, the self-terminating male connector can be used with a prior art female f connector without having to modify the f connector.

Having thus described a preferred embodiment of the present invention, it should be apparent that other modifications and improvements can be made without departing from the scope of the invention as defined by the appended claims. One could employ other types of springs or biasing means, or other mechanical switching means for selectively coupling the two conductors in the connector. Moreover, in some embodiments it may not be necessary for the receptacle in a female connector to be conducting if a good connection can be formed between a prong and a movable conductor. Furthermore, while it is preferable that only one of the male or female be altered for use with a known connector, other arrangements could be used in which both connectors are modified.

What is claimed is:

1. A male f-type connector for connection to a corresponding female f-type connector, the connector comprising:.

a housing;

a first conductor having a generally axial portion in the housing, wherein the first conductor includes a prong;

a second conductor coaxial to the generally axial portion; and switching means mounted in the housing for selectively coupling the first and second conductors, wherein when the switching means is in a first position, the first conductor is electrically coupled to the second conductor, and when the switching means is in a second position, the first conductor and the second conductor are substantially electrically insulated from each other within the connector, the switching means being switched from the first position to the second position when the male connector and the female connector are connected, and being automatically switched from the second position to the first position when the male connector and the female connector are disconnected so that the connector self-terminates when disconnected, wherein the switching means includes a spring for biasing the prong.

2. The connector of claim 1, wherein the spring is moved in response to the connection and disconnection of the first and second connectors.

3. The connector of claim 1, wherein the spring is a coil spring.

4. The connector of claim 1, wherein the switching means includes a conductive movable portion coupled to the spring, and the second conductor includes a conductive stationary member, wherein the movable portion is biased against the stationary member when the switching means is in the first position.

5. The connector of claim 1, wherein the second conductor includes a stationary member adjacent a portion of the first conductor, and a portion disposed circumferentially about the housing.

6. The connector of claim 5, further comprising a 75 ohm resistance coupled between the stationary member and the portion disposed circumferentially.

7. A male connector for connection to a female connector, the male connector comprising:

a housing;

a first conductor in the housing and having a generally axial male prong;

a second conductor, at least part of which is coaxial to the male prong; and switching means mounted in the housing for selectively coupling the first and second conductors wherein when the switching means is in a first position, the first conductor is electrically coupled to the second conductor, and when the switching means is in a second position, the first conductor and the second conductor are substantially electrically insulated from each other within the connector, the switching means being switched from the first position to the second position when the male connector and the female connector are connected, and being automatically switched from the second position to the first position when the male connector and the female connector are disconnected so that the connector self-terminates when disconnected;

wherein the switching means includes a conductive member coupled to the male prong and the male prong is spring biased, wherein the male prong and the conductive member move together when the male connector is inserted in a female connector.

8. The connector of claim 7, wherein the conductive member is integrally formed with the prong.

9. An apparatus comprising:

a first connector for mating with a second connector and a third connector, the first connector including:

a housing;

a first conductor mounted to the housing; and a second conductor mounted to the housing;

wherein one of the first and second conductors includes a movable body that is movable from a first position for electrically coupling the first and second conductors to each other so that a signal flows between the first conductor and the second conductor, to a second position wherein the first conductor and the second conductor are substantially electrically insulated from each other, the movable body being moved automatically in response to the mating of the first connector with the second connector so that the first connector self-terminates when the second connector is not connected to the first connector;

wherein the first conductor and the second conductor are mounted so that the second connector is received at one end of the housing, the apparatus further comprising a third conductor electrically coupled to the movable body, the third conductor being at another end of the housing for coupling to a third connector.

10. The apparatus of claim 9, wherein the first and third connectors are the female type, the third conductor is a male prong, and the movable conductor is coupled to the male prong.

11. The apparatus of claim 10, wherein the movable conductor is spring biased.

12. A female connector comprising:

a housing;

a first conductor having a generally axial portion in the housing;

a second conductor, at least a portion of which is coaxial to the generally axial portion; and switching means selectively coupling the first and second conductors, wherein when the switching means is in a first position, the first conductor is electrically coupled to the second conductor, and when the switching means is in a second position, the first conductor and the second conductor are substantially electrically insulated from each other, the switching means being switched from the first position to the second position when the first connector and the second connector are connected, and being automatically switched from the second position to the first position when the first connector and the second connector are disconnected so that the first connector self-terminates when disconnected, the switching means being completely enclosed by the housing such that the first connector is externally unchanged as the switching means is switched from the first position to the second position, wherein the switching means includes a cup adjacent an inner end of the elongated receptacle, and means, at a base of the cup, for receiving a male prong of the second connector.

13. A first connector for mating with a male second connector and a female third connector, the first connector comprising:

a housing;

a conductor mounted circumferentially around the housing;

the housing having a female end with a receptacle for mating with the male second connector, and a male end opposite the female end and having a conductive prong for mating with the female third connector; and switching means movable between a first position for electrically coupling the male second connector and the female third connector so that a signal flows therebetween, and a second position wherein the male second connector is substantially electrically insulated from the female third connector, the switching means being activated automatically in response to the connection and disconnection of the first connector with the second connector.

14. The first connector of claim 13, wherein the switching means includes a spring that is biased to the first position and is moved to the second position when the second connector is connected to the first connector.

15. The first connector of claim 13, first connector having a male prong at the male end, the switching means being adjacent the male prong.

* * * * *